United States Patent [19]

Sherman

[11] 4,237,987

[45] Dec. 9, 1980

[54] PERCUSSIVE TOOL

[76] Inventor: Victor L. Sherman, 115 Logan St., Apt. 2D, Brooklyn, N.Y. 11208

[21] Appl. No.: 955,468

[22] Filed: Oct. 27, 1978

[51] Int. Cl.[3] ..... B25D 17/24; B25D 11/04

[52] U.S. Cl. ..... 173/117; 173/139

[58] Field of Search ..... 173/117, 119, 139, 133; 310/30; 318/114; 267/137; 175/56

[56] References Cited

U.S. PATENT DOCUMENTS

| | | | |
|---|---|---|---|
| 1,791,988 | 2/1931 | Weibull | 173/117 |
| 2,078,924 | 5/1937 | Clerk | 173/139 |
| 2,254,823 | 9/1941 | Kroll | 117/117 |
| 3,451,492 | 6/1969 | Ekstrom | 173/139 |
| 3,788,404 | 1/1974 | Koudelka et al. | 173/139 |
| 3,878,412 | 4/1975 | Kurpanek | 173/117 X |

FOREIGN PATENT DOCUMENTS

| | | | |
|---|---|---|---|
| 274724 | 6/1970 | U.S.S.R. | 173/119 |
| 581252 | 11/1977 | U.S.S.R. | 173/119 |

*Primary Examiner*—Werner H. Schroeder
*Assistant Examiner*—Andrew M. Falik
*Attorney, Agent, or Firm*—Ilya Zborovsky

[57] ABSTRACT

A percussive tool includes a tool member and a member imparting strikes to the former. The tool member is located in a tool casing which is movable relative to a housing. A spring is located between the tool casing and the housing so as to substantially prevent transmission of impacts from the former to the latter. The tool housing is provide with a recess at a trailing end thereof into which a leading end of the imparting member can be received whereby the imparting member does not make contact with the tool casing. The axial length of the recess is such that when the tool casing is urged rearwardly to its initial position, a wall surrounding the recess surrounds the leading end of the imparting member.

6 Claims, 2 Drawing Figures

PERCUSSIVE TOOL

BACKGROUND OF THE INVENTION

The present invention relates to a percussive tool, and more particularly to a magnetically operated percussive tools.

Known percussive tools include housing means, a tool member reciprocable in the housing means and surrounding the tool member, and a member which imparts impacts to the tool member under the action of magentic flux generated by a source. In the known tool the tool casing is fixedly connected with the housing means whereby the latter is subjected to impacts during the operation which are transmitted to the user's hand. Still another disadvantage of the known construction is that when the impacting element strikes against a trailing end of the tool member it also strikes against a trailing end of the tool casing so that the latter is prematurely destroyed.

SUMMARY OF THE INVENTION

Accordingly, it is an object of the present invention to provide a percussive tool which avoids the disadvantages of the prior art.

More particularly, it is an object of the present invention to provide a percussive tool in which impacts are not or substantially not transmitted from a tool casing to a housing of the tool.

Still another feature of the present invention is to provide a percussive tool in which a member imparting strikes to a tool member does not strike against a tool casing surrounding the tool member.

In keeping with these objects and with others which will become apparent hereinafter one feature of the present invention resides, briefly stated, in a percussive tool in which spring means is provided between a tool casing and a housing so that impacts are substantially not transferred from the tool casing to the housing. On the other hand, a trailing end of the tool casing is provided with a recess having such as axial length that when the spring means urges the tool casing toward an impact imparting member the latter being received into the recess, does not strike the tool casing and admits magnetic flux from the tool casing.

The novel features which are considered to be characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
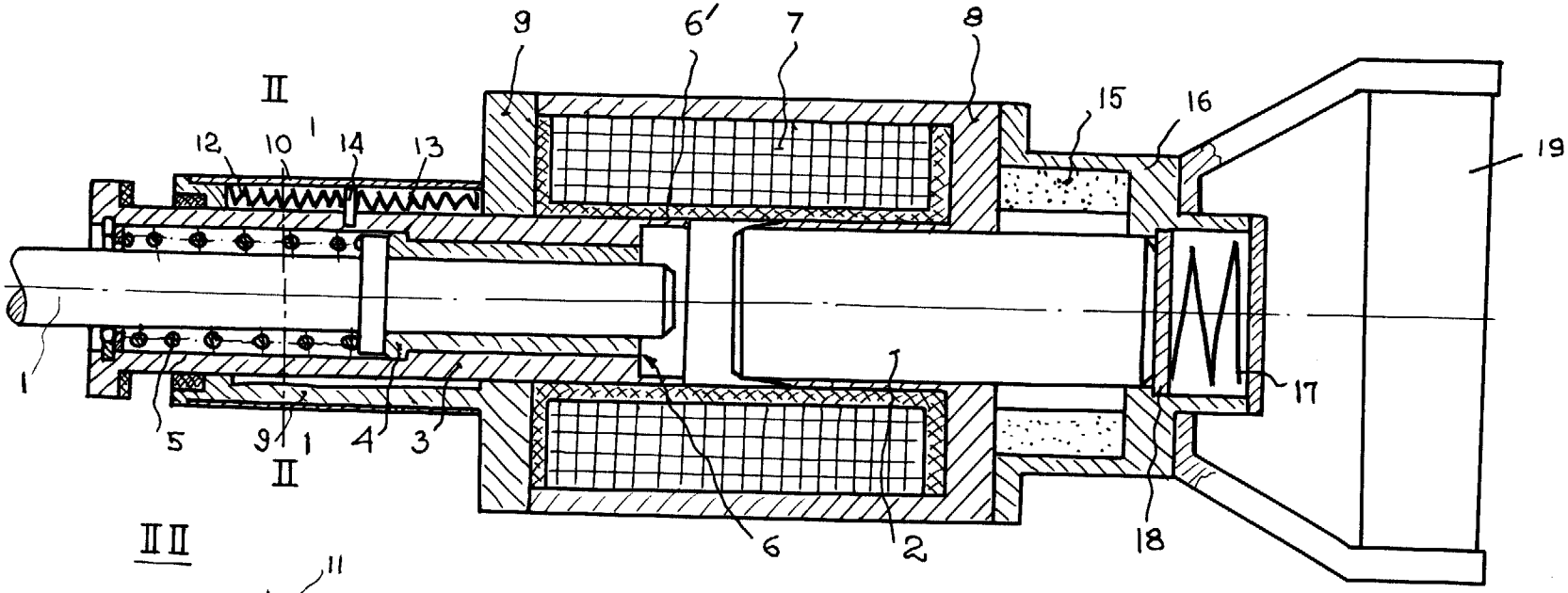
FIG. 1 is a view showing a percussive tool in accordance with the present invention.

A percussive tool in accordance with the present invention includes a tool member 1, and a member imparting impacts to the tool member, such as a piston 2 The tool member 1 is located in a tool casing 3 with interposition of a bushing 4. A spring 5 is located between a portion of the tool casing 3 and an abutment of the tool member 1 and is operative for urging the latter toward the piston 2.

Figure 2:
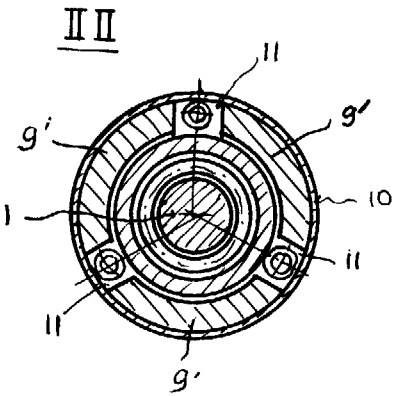
FIG. 2 is a section taken through line II—II of FIG. 1.

The tool casing 3 is provided at a trailing end thereof with a recess 6 which is bounded by a circumferential wall 6'. An electromagnet 7 having a body and a winding is accommodated in housing means including a housing 8 which is closed by a magnetoconductive cover 9. A cap 10 is provided forwardly of the cover 9. The latter has several axial projections extending into the interior of the cap 10, as shown particularly in FIG. 2. The projections 9' bound therebetween a plurality of circumferential gaps 11.

Spring means are accommodated in the gaps 11. The spring means include first springs 12 and second springs 13 which abut against a projection 14 at opposite sides thereof. The projection 14 substantially radially extends from the tool casing 3. The tool casing 3 is movable relative to the housing means in an axial direction. A permanent magnet 15 with a pole 16, and a spring 17 located between the latter and a washer 18 is provided.

The percussive tool in accordance with the present invention operates in the following manner. A magnetic flux generated by the electromagnet 7 is transmitted to the tool casing 3 through the cover 9 whereby the tool casing pulls by a magnetic force the impacting member 2 toward the tool member 1. The springs 12 are somewhat relaxed whereas the springs 13 serve for absorbing purposes. The impacting member 2 strikes the tool member 1. At the same time, impacts are transmitted to the tool casing 3, the latter moves forwardly and compresses the springs 12 which serve now for absorbing purposes. After the strike the permanent magnet 15 returns the impacting member 2 to its initial position. The spring 5 urges the tool member 1 toward the impacting member 2, and the springs 13 urge the tool casing to its initial position. The recess 6 has such an axial length that when the tool casing 3 is moved to its initial position which is proximal to the impacting member 2, the wall 6' radially outwardly surrounds a leading end portion of the impacting member 2. Thereby, the magnetic flux is effectively transmitted in optimum manner from the tool casing 3 to the impacting member 2.

It will be understood that each of the elements described above may also find a useful application in other types of tool differing from the type described above. Various modifications and structural changes may be mademade without departing in any way from the spirit of the present invention. The foregoing so fully reveal the gist of the invention that others by applying current knolegde can readily adapt it for various applications without omitting features, that from standpoint of the prior art, fairly constitutes essential chracteristics of the generic or specific aspects of the invention.

What is claimed as desired to be protected by Letters Patent is set forth in the appended claims:

1. A percussive tool, comprising housing means;

a tool member having an axis and reciprocable in said housing means in an axial direction;

a tool casing movable in said housing means in said axial direction in two axially opposite directions and surrounding said tool member so that the latter is movable relative to said tool casing, said tool member being movable relative to said housing means;

a reciprocable member imparting impacts to said tool member under the direct action of magnetic flux generated by a source; and spring means between said tool casing and said housing means and operative for preventing transmission of impacts from said tool casing to said housing means, said spring means including a first spring member operative for absorbing impacts of said tool casing during its movement in one of said axial directions, and a second spring operative for absorbing impacts of said tool casing during its movement in other of said axial directions.

2. A percussive tool as defined in claim 1, where in said tool casing is provided with a substantially axial projection, said housing means having two abutments located at opposite axial sides of said projection, said first spring being located between said projection and one of said abutments, whereas said second spring is located between said projection and the other abutment.

3. A percussive tool as defined in claim 1; said housing means having a first magnetoconductive portion surrounding said source and a second portion radially outwardly surrounding said spring means, said second portion being cylindrical and having a plurality of projections extending axially into its interior so as to form a plurality of gaps therebetween, said spring means including a plurality of springs each located in a respective one of said gaps.

4. A percussive tool, comprising housing means;

a reciprocable tool member in said housing means;

a reciprocable member imparting impacts to said tool member under the direct action of magnetic flux generated by a source;

a tool casing movable in said housing means and surrounding said tool member so that the latter is movable relative to said tool casing and said tool casing is movable relative to said housing means, said tool casing having a trailing end which faces toward said imparting member and is provided with a recess at said trailing end so that when said imparting member strikes against said tool member said imparting member is freely received into said recess and does not contact said tool casing;

spring means between said tool casing and said housing means and operative for preventing transmission of impacts from said tool casing to said housing means.

5. A percussive tool as defined in claim 4, wherein said casing is in magnetic contact with a source of magnetic flux so that the latter is transferred to said tool casing whereby said tool casing urges said imparting member to strike against said tool member, said recess of said tool casing being bounded by a circumferential wall and having such axial length that when said spring means urges said tool casing toward said imparting member after a strike, said wall bounding said recess circumferentially outwardly surrounds a portion of said imparting member so as to transmit the magnet flux to the latter.

6. A percussive tool as defined in claim 4; and futher comprising further spring means located between said tool member and said tool casing and operative for urging the former toward said imparting member.

* * * * *